US007879214B2

(12) United States Patent
Schnelle et al.

(10) Patent No.: US 7,879,214 B2
(45) Date of Patent: Feb. 1, 2011

(54) METHOD AND DEVICE FOR COLLECTING SUSPENDED PARTICLES

(75) Inventors: Thomas Schnelle, Berlin (DE); Torsten Muller, Berlin (DE); Jorg Kentsch, Tubingen (DE); Frank Grom, Schwenningen (DE); Martin Stelzle, Reutlingen (DE)

(73) Assignee: Perkinelmer Cellular Technologies Germany GmbH, Hamburg (DE)

( * ) Notice: Subject to any disclaimer, the term of this patent is extended or adjusted under 35 U.S.C. 154(b) by 990 days.

(21) Appl. No.: 11/568,895

(22) PCT Filed: May 6, 2005

(86) PCT No.: PCT/EP2005/004925

§ 371 (c)(1),
(2), (4) Date: Jan. 15, 2007

(87) PCT Pub. No.: WO2005/110605

PCT Pub. Date: Nov. 24, 2005

(65) Prior Publication Data

US 2007/0221501 A1 Sep. 27, 2007

(30) Foreign Application Priority Data

May 12, 2004 (DE) ..... 10 2004 023 466

(51) Int. Cl.
*B03C 5/02* (2006.01)

(52) U.S. Cl. ..... 204/547; 204/643

(58) Field of Classification Search ..... 204/547, 204/643

See application file for complete search history.

(56) References Cited

U.S. PATENT DOCUMENTS 4,440,638 A 4/1984 Judy et al.

(Continued)

FOREIGN PATENT DOCUMENTS

DE 19653659 C1 5/1998

(Continued)

OTHER PUBLICATIONS

Hoettges et al., "Optimizing Particle Collection for Enhanced Surface-Based Biosensors", IEEE Engineering in Medicine and Biology Magazine, pp. 68-74 (2003).

(Continued)

*Primary Examiner*—Nam X Nguyen
*Assistant Examiner*—J. Christopher Ball
(74) *Attorney, Agent, or Firm*—Caesar, Rivise, Bernstein, Cohen & Pokotilow, Ltd.

(57) ABSTRACT

A description is given of methods for collecting particles (1, 2) which are suspended in a liquid, including the following steps: providing the liquid containing the suspended particles (1, 2) in a compartment (10) having lateral surfaces (11), wherein at least one electrode (21) is arranged on at least one of the lateral surfaces (11), and generating high-frequency electric fields by means of the at least one electrode (21) so as to form at least one circulating flow (30), by means of which the particles (1, 2) are guided to at least one predetermined collecting area (40) in the compartment (10), wherein the flow (30) is formed in such a way that at least one branch of the flow runs along a longitudinal extent of the at least one electrode (21), and the flow (30) circulates about an axis (31) which is oriented perpendicular to the respectively adjacent lateral surface (11) with the electrode (21). Corresponding devices for collecting particles are also described.

35 Claims, 4 Drawing Sheets

U.S. PATENT DOCUMENTS

| | | | | |
|---|---|---|---|---|
| 6,492,175 | B1 | 12/2002 | Muller et al. | |
| 6,610,188 | B1 | 8/2003 | Fuhr et al. | |
| 6,673,225 | B1 | 1/2004 | Arnold | |
| 2004/0013584 | A1 | 1/2004 | Arndt et al. | |
| 2004/0040848 | A1 * | 3/2004 | Schnelle et al. | 204/450 |
| 2004/0063196 | A1 | 4/2004 | Muller et al. | |
| 2006/0024802 | A1 | 2/2006 | Muller et al. | |

FOREIGN PATENT DOCUMENTS

| | | | |
|---|---|---|---|
| DE | 19859459 | A1 | 6/2000 |
| DE | 19903001 | A1 * | 8/2000 |
| DE | 19983263 | T1 | 5/2001 |
| DE | 10059152 | C2 | 3/2003 |
| DE | 10224150 | A1 | 12/2003 |
| DE | 10255858 | A1 | 6/2004 |
| DE | 10320869 | A1 | 12/2004 |
| EP | 1413911 | A1 | 4/2004 |
| WO | 0045147 | A2 | 8/2000 |
| WO | 2004098777 | A3 | 11/2004 |

OTHER PUBLICATIONS

Muller et al., "A traveling-wave micropump for aqueous solutions: Comparison of 1 g and μg results", Electrophoresis, pp. 764-772 (1993).

Muller et al., "High Frequency Electric Fields for Trapping of Viruses", Biotechnology Techniques, vol. 10, pp. 221-226 (1996).

Muller et al., "Trapping of micrometre and sub-micrometre particles by high-frequency electric fields and hydrodynamic forces", J. Phys. D: Appl. Phys., vol. 29, pp. 340-349 (1996).

Schnelle et al., "Trapping in AC octode field cages", Journal of Electrostatics, vol. 50, pp. 17-29 (2000).

Schnelle et al., "Trapping of Viruses in High-Frequency Electric Field Cages", Naturwissenschaften, vol. 83, pp. 172-176 (1996).

PCT/EP2005/004925 International Search Report.

* cited by examiner

METHOD AND DEVICE FOR COLLECTING SUSPENDED PARTICLES

BACKGROUND OF THE INVENTION

The invention relates to a method for collecting particles which are suspended in a liquid, in particular for collecting suspended biological objects, such as biological cells for example, in a fluidic microsystem. The invention also relates to a device for implementing such a method and to the uses thereof.

It is known to trap or collect particles which are suspended in a liquid in fluidic Microsystems in a dielectrophoretic field cage (see, for example, the publication "Trapping in AC octopole field cages" by T. Schnelle et al. in "Journal of Electrostatics", vol. 50, 2000, pages 17 to 29). This technique has the disadvantage that only relatively large particles with typical dimensions >500 nm can reliably be trapped. In the case of smaller particles, such as viruses for example, the dielectrophoretic trapping forces may be too low or may be superposed by thermal distortions.

Using planar electrodes to which high-frequency AC voltages are supplied, electrohydrodynamic flows can be generated in a liquid-filled compartment by means of electroosmosis. In the publication "Optimizing Particle Collection for enhanced surface-based biosensors" (see "IEEE ENGINEERING IN MEDICINE AND BIOLOGY MAGAZINE", November/December 2003, page 68), K. F. Hoettges et al. describe the use of circulating electrohydrodynamic flows to collect particles which are suspended in the liquid. In this method, as shown in FIG. 9, suspended particles 1', 2' are collected in a compartment 10' having a lateral surface 11'. At the edges of electrodes 21' (partially shown), which are arranged on the lateral surface 11', an eddy flow 30' is produced which circulates about an axis 31' parallel to the orientation of the lateral surface 11'. A region where the flow is calm is formed in the centre of the electrodes 21', which region represents a collecting area 40' for the particles brought between the electrodes 21' by the eddy flow 30'.

The technique described by K. F. Hoettges et al. has a number of disadvantages, in particular with regard to use in biology, biochemistry and medicine. The circulating eddy flow has a relatively small catchment area for the particles to be collected. Furthermore, the particles can be collected only immediately next to the electrodes. However, contact with the electrodes may be harmful for the particles, particularly if the particles comprise biological materials. Moreover, electrodes with a relatively large surface area are required in order to form suitably large collecting areas. However, undesirable heating occurs on electrodes with a large surface area. Finally, one significant disadvantage of the technique described by Hoettges et al. lies in the fact that said technique is based on electroosmosis and positive electrophoresis and therefore is restricted to low frequencies and low conductivities of the solutions used. It is therefore not possible to use this method to investigate cells in physiological solutions.

It is also known to guide viruses 1' into the trapping area of a funnel-shaped, dielectric field cage 50' by using electrohydrodynamic flows 30', as shown in FIG. 10 (see the publication "Trapping of Viruses in High Frequency Electric Field Cages" by T. Schnelle et al. in "Naturwissenschaften" vol. 83, 1996, pages 172 to 176; the publication "High Frequency Electric Fields for Trapping of Viruses" by T. Müller et al. in "Biotechnology Techniques" vol. 10, 1996, pages 221 to 226; and the publication "Trapping of micrometer and sub-micrometer particles by high frequency electric fields and hydrodynamic forces" by T. Müller et al. in "J. Phys. D: Appl. Phys." vol. 29, 1996, pages 340 to 349). Also in this technique there is the disadvantage that the collecting flow only collects viruses in the immediate vicinity of the electrodes 21' used to form the field cage 50' and therefore has a relatively small catchment area. Moreover, said method is restricted to low conductivities or low-salt solutions and is therefore also not suitable for investigating cells in physiological solutions.

Flows in fluidic Microsystems can also be induced by high electric field strengths (electric heating). However, this principle, which is used for example in traveling wave pumps in microchips (see the publication "A travelling-wave micropump for aqueous solutions: Comparison of 1 g and μg results" by T. Müller et al. in "Electrophoresis", vol. 14, 1993, pages 764 to 772), may be disadvantageous for biological particles in particular, due to the conversion of heat.

The objective of the invention is to provide improved methods for collecting particles which are suspended in a liquid, in particular for collecting suspended biological objects, by means of which the disadvantages of the conventional methods are overcome and which in particular permit collection from a larger catchment area and without harm to the collected particles. Another objective of the invention is to provide improved devices for collecting particles which are suspended in a liquid, in particular for implementing the methods according to the invention.

SUMMARY OF THE INVENTION

In terms of the method, the invention is based on the general technical teaching of collecting suspended particles in at least one collecting area in a compartment with a circulating flow which runs at least partially along a longitudinal extent of at least one electrode on a lateral surface of the compartment. The collecting area is the volume into which the flow guides the particles and in which the particles may collect in particular due to a local reduction in flow. The circulating flow, which is generated according to the invention by an interaction of the liquid with high-frequency electric fields at the electrode, advantageously runs in a plane parallel to the respective lateral surface. The inventors have found that the limitation in terms of the effectiveness of collection in the conventional techniques can be overcome and the catchment area of the flow circulating at the electrode can be enlarged if the flow no longer circulates as previously about an axis parallel to the orientation of the lateral surface, but rather has a local axis of rotation perpendicular to this lateral surface. Another significant advantage of the invention consists in that even very small particles, such as viruses for example, can be effectively collected by the at least one flow.

The net liquid stream in the circulating flows is zero, since there is no source or sink in the collecting area and the liquid is incompressible. Nevertheless, a net particle stream from the outside towards the inside is observed. This can be explained by the fact that, due to negative dielectrophoresis, the particle concentration between the electrodes (liquid stream directed towards the outside) is lower than in the area surrounding the electrodes (liquid stream directed towards the inside).

If, according to one preferred embodiment of the invention, the particles are collected in the collecting area without any mechanical contact with a wall or any other part of the compartment, advantages may be obtained with regard to the manipulation of biological particles, such as biological cells for example, which in the event of mechanical contact would react with undesirable changes in state. However, if mechanical contact even is desired, then according to an alternative embodiment of the invention the particles can be arranged in the collecting area with contact with a lateral surface of the compartment. A measurement through a compartment wall can thus advantageously be simplified. Even if collection takes place with contact with the lateral surface, it is possible to prevent any contact with the electrodes and thus an undesirable electrode reaction, unlike in the case of the conventional techniques using electroosmosis. In this case, the collecting area can be formed by a part of the lateral surface in which the wall material of the compartment is exposed and no electrodes are present.

According to one particularly preferred embodiment of the invention, a number of locally circulating flows are generated at least one electrode, of which in each case at least one branch of the local circulation is directed towards the at least one collecting area. Two flows, for example, run along the electrode. This advantageously increases the effectiveness of collection.

Further increase in size of the catchment area for collection can advantageously be achieved if, according to one variant of the method according to the invention, a plurality of locally circulating flows are generated at a plurality of electrodes. This makes it possible in particular for the particles to be guided towards the at least one collecting area from a number of directions. If the flows relative to one another are designed to be symmetrical, in particular point-symmetrical, with respect to the collecting area in such a way that the latter contains a calm flow or is essentially free of flow, the situation can advantageously be achieved whereby the particles conveyed from one side to the collecting area do not leave the collecting area in another direction, e.g. at the opposite side.

Since, according to the invention, the flow is generated along the longitudinal extent of the respective electrode, the catchment area can advantageously be expanded by means of elongate or strip-shaped electrodes which preferably extend radially from the collecting area in different directions.

According to another advantageous embodiment of the invention, the particles are collected from a catchment area of the compartment which has a volume that is $10^2$ to $10^9$ times greater than the volume of the collecting area. This ratio indicates that the method according to the invention can be used not only to collect particles, but also to concentrate or accumulate them at a high factor. By way of example, the catchment area of a single eddy may have a volume of up to 10 μl and the collecting area may have a volume of from 1 femtoliter up to 50 picoliters, so that the invention can advantageously be implemented with fluidic microsystems.

According to one particularly preferred embodiment of the invention, high-frequency electric fields are also used to directly exert a predefined dielectrophoretic driving force on the particles. Under the effect of the high-frequency electric fields, the particles are moved towards the collecting area by means of negative dielectrophoresis. The indirect hydrodynamic force effect is advantageously further amplified as a result. It is particularly preferred if, according to the invention, high-frequency electric fields are generated which are used for electrodynamic flow generation and simultaneously for the dielectrophoretic manipulation of the particles.

The effectiveness of collection can be further increased if the high-frequency electric fields are used to generate at least one dielectrophoretic field cage with a potential minimum located in the collecting area. The dielectrophoretic trapping forces in the field cage are dependent on the particle size. Advantageously, particles which are so small that the trapping forces of the field cage would be too weak for effective collection can be bound by means of the electrohydrodynamic flows to form larger aggregates in such a way that field forces which are sufficient for reliable trapping in the field cage are achieved. According to the invention, the field cage is closed in two spatial directions (funnel-shaped field cage) or three spatial directions (field cage that is closed on all sides). The field cage can be formed with 6, 8 or more electrodes.

If, according to one advantageous variant of the invention, electrodes are arranged and supplied with high-frequency electric voltages in such a way that a plurality of field cages are formed, it is advantageously possible to further increase the size of the catchment area for particle collection according to the invention. Preferably an inner field cage and an outer field cage are provided, the potential minima of which occupy the same position in the collecting area. The field cages are arranged concentrically with respect to one another, wherein the respective outer field cage moves particles towards the inner field cage by means of negative dielectrophoresis.

It may be provided according to the invention that, in the collecting area, at least one further force acts on the particles. Additional holding and/or manipulation of the particles in the collecting area can thus advantageously be achieved. The generation of an optically active force may have advantages when combining the technique according to the invention with an optical measurement in the collecting area and for selective particle manipulation. The generation of a dielectrophoretic force may have advantages for effective cooperation with a dielectrophoretic barrier of the field cage. An additional magnetic force offers advantages when manipulating magnetic particles. Finally, the at least one further force may be a force generated by ultrasound, for example nodes of an ultrasonic field may be formed in the collecting area.

In order to exert a further force, the possibility further exists that a start object is located in the collecting area, e.g. a bead which can also be functionalized. Due to this start object, the particles are influenced not only by dielectric interactions, but rather also possibly by specific binding to the bead or hydrodynamic shielding brought about by the start object.

According to another preferred embodiment of the invention, in the collecting area, at least one measurement is carried out on the collected particles. This may bring advantages in particular when manipulating or evaluating collected biological particles. The measurement preferably comprises an electrical, electrochemical and/or optical measurement known per se for example from the field of fluidic microsystems.

According to one preferred application of the invention, the measurement is aimed at detecting a receptor/ligand binding event. For this measurement, according to the invention, the lateral surface of the compartment may be functionalized in the region of the at least one collecting area with detection spots in the form of receptor molecules (e.g. proteins, antibodies, DNA, viruses (for transfection experiments), etc.), as known per se from conventional microarrays or biochips, so that a specific receptor/ligand interaction with particles or molecules accumulated in the collecting area takes place. The interaction can then be detected in a known manner, e.g. by way of electrical, electrochemical or optical reading methods.

Advantageously, with the method according to the invention, the concentration of analyte particles or analyte molecules in the vicinity of the detection spots can be increased (increase in sensitivity) and the detection process can be accelerated compared to the purely diffusive transport of analyte particles or analyte molecules to the detection spots.

The functionalized receptor array can be applied for example to a flat electrode and, together with a second substrate containing the collecting electrodes, forms a microchamber. After accumulation of the analyte particles or analyte molecules by the method according to the invention and the binding of the same to the immobilized receptors on the array, the collecting structure can then be removed again. It can accordingly also be used multiple times.

If, according to a further modification of the invention, the particles are collected in a plurality of collecting areas in the compartment, advantages may be obtained in respect of parallel accumulation of the particles from a plurality of catchment areas in the compartment and parallel manipulation or evaluation of the collected particles.

For use in fluidic microsystems, one particular advantage of the invention is that collection can take place not just from a catchment area with a suspension liquid at rest, but even dynamically from a moving suspension liquid. The compartment may for example be passed through by a laminar flow which according to the invention is superposed with the locally circulating flow at the electrodes.

Furthermore, mutual superposition of a plurality of locally circulating flows may be provided in the compartment. A first circulating flow can guide the particles directly into a collecting area which forms part of a further circulating flow arranged downstream. This makes it possible to arrange a plurality of circulations in the manner of a cascade, in which particles are guided from an expanded catchment area into a single collecting area.

The method according to the invention is particularly suitable for collecting particles with a diameter of less than 1 μm. For biological applications, it is thus advantageously possible to collect in particular cells, viruses, bacteria, proteins, cell constituents and/or biological macromolecules, e.g. DNA.

According to further variants of the invention, it may be provided that the flows circulating locally at the electrodes are amplified by a local temperature gradient in the liquid. The temperature gradient may be formed by local heating of the liquid, which preferably takes place by exposing the liquid and/or lateral surfaces of the compartment to light and the corresponding absorption thereof and/or by means of thermoelements embedded ("buried") in the walls. The temperature gradient may alternatively or additionally be formed by local, targeted cooling of the liquid.

The local heating of the liquid may advantageously also be used to initiate chemical reactions. The local high temperatures in the collecting area may in this case initiate e.g. heat-activated reactions, such as aggregation or precipitation.

In terms of the device, the abovementioned object of the invention is achieved by a collecting device for collecting suspended particles, which comprises, on a lateral surface of a compartment for holding a liquid, at least one electrode for generating one or more locally circulating flows in the liquid, by means of which suspended particles can be guided to at least one predetermined collecting area in the compartment, wherein the collecting device is designed to generate the at least one flow in such a way that part of the flow extends along the longitudinal extent of the electrode and the flow circulates about an axis which is oriented perpendicular to the respectively adjacent lateral surface with the electrode.

According to advantageous variants of the invention, the collecting area may be arranged at a distance from the lateral surfaces of the compartment or may be arranged in such a way that the collecting area is in contact with one of the lateral surfaces.

The electrode at which the at least one circulating flow can be generated is preferably connected to a voltage source for supplying predefined high-frequency electrical voltages. The at least one electrode which is used to generate the circulating flow is also referred to as the collecting electrode. When generating a plurality of circulating flows which are directed towards one or more collecting areas, the collecting device accordingly comprises a plurality of collecting electrodes, which form a collecting electrode array.

If, according to one preferred embodiment of the invention, the collecting device is designed to exert on the particles to be collected not just electrohydrodynamic forces but also dielectrophoretic forces, the effectiveness of collection can be improved by the additional force effect. The dielectrophoretic force effect is exerted by the interaction of the particles with high-frequency electric fields which are generated in the compartment by at least one electrode, which will be referred to hereinafter as the cage electrode. If the abovementioned field cages which are closed on one or all sides are to be generated, the compartment is equipped with a cage electrode array.

According to a particularly preferred variant of the invention, the collecting electrodes and cage electrodes are identical. The collecting electrode array and cage electrode array are formed by a common electrode arrangement. In this case, the structure of the collecting device and the activation of the electrodes is simplified.

One particular advantage of the collecting device according to the invention consists in the fact that it can be miniaturized. The compartment of the collecting device preferably forms part of a fluidic microsystem. The collecting function according to the invention can advantageously be combined with collecting, sorting, evaluation or measurement functions of the microsystem. The collecting device is arranged for example in the channel of a fluidic microsystem, which forms said compartment with the flow generator. Surprisingly, with the collecting device according to the invention, a collection of particles can also take place in the flowed-through channel.

In order to increase the collection activity, it may be provided according to one modification of the invention that a plurality of collecting areas are arranged in a row along a longitudinal direction of the channel.

Particular advantages for an expanded field of application of the collecting device are obtained when said device is equipped with a magnetic field device for exerting a magnetic holding force in said collecting area and/or with a measuring device for detecting electrical, electrochemical or optical properties of particles in the collecting area.

According to further variants of the invention, the flow generator may additionally comprise a heating device and/or a light source.

BRIEF DESCRIPTION OF SEVERAL VIEWS OF THE DRAWINGS

Further details and advantages of the invention will become apparent from the following description of examples of embodiments and from the appended drawings, in which.

DETAILED DESCRIPTION OF PREFERRED EMBODIMENTS

The embodiments of the invention will be described below with reference to the application of the invention in fluidic microsystems for dielectrophoretic particle manipulation. Such fluidic microsystems, their components and their operating methods are known per se and will therefore not be described below. The invention will be discussed below by way of example with reference to a configuration in which electrodes are used both for collection and to exert a dielectrophoretic driving force, that is to say in which the collecting electrodes and cage electrodes are identical. It should be mentioned that the implementation of the invention is not restricted to this embodiment. Rather, according to the invention, collecting electrodes may be used exclusively to generate an electrohydrodynamic flow and not form part of a dielectric field cage, as illustrated for example in FIG. 6 or 7 (see below). It should furthermore be mentioned that the application of the invention is not restricted to fluidic Microsystems for dielectrophoretic particle manipulation, but rather can be used in other cases in which suspended particles in liquid-filled compartments, e.g. laboratory vessels, are to be collected, in particular for biochemical tasks.

Figure 1:
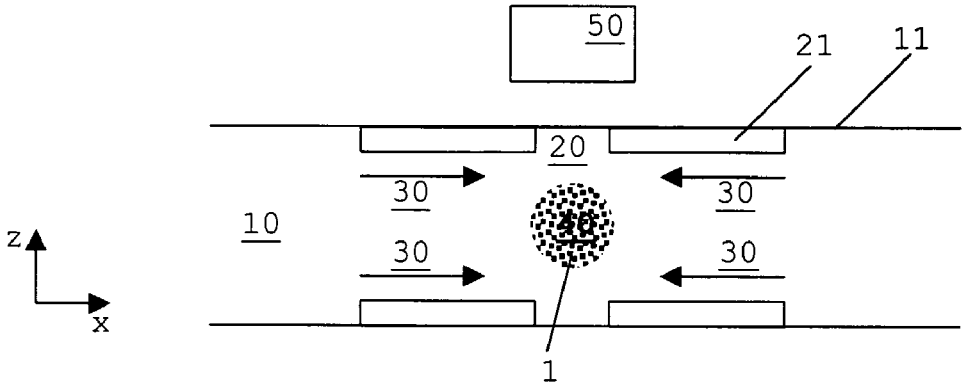
FIG. 1 shows a schematic sectional view of one embodiment of a collecting device according to the invention.

FIG. 1 illustrates, in an enlarged schematic sectional view, part of a channel or some other section of a fluidic microsystem which forms the compartment 10 of the collecting device according to the invention. An electrode arrangement 20 with eight electrodes 21 is arranged on the channel walls, which represent lateral surfaces 11 of the compartment 10. Four electrodes 21 are arranged on each of the lower lateral surface (bottom surface) and the upper lateral surface (top surface), resp. (see also FIGS. 2, 3). The electrode arrangement 20 is formed in a manner known per se from electrode arrangements for generating dielectrophoretic field cages.

Each electrode for electrohydrodynamic flow generation has the shape of a strip or band with a length (see also FIGS. 2, 3) which is much greater than the electrode width. The aspect ratio of electrode width:electrode length is preferably selected to be in the range from 1:10 to 1:100. The dimensions of the electrode 21 are, for example, 10 μm·500 μm. A longitudinal orientation of the electrode 21 is defined by the elongate electrode shape. Each electrode 21 is arranged in such a way that the longitudinal orientation points towards a collecting area 40 in the centre between the lateral surfaces 11 or towards the perpendicular projection of the collecting area on the respective lateral surface 11. The electrodes 21 are electrically connected in a manner known per se to a voltage source for generating high-frequency electric voltages, preferably with predefinable amplitudes, frequencies and phase relationships. When the electrodes 21 are supplied with the high-frequency electric voltages, flows 30 are formed parallel to the lateral surfaces 11, by means of which flows 30 particles 1 are moved towards the collecting area 40.

Reference numeral 50 denotes a measuring device, for example a microscope with a CCD camera, by means of which for example fluorescence-marked particles in the collecting area can be optically measured and evaluated. To this end, at least one optically transparent window is provided in the lateral surface 11 of the channel (see FIG. 5). As an alternative or in addition, the measuring device provided may be at least one further electrode for impedance measurements in the collecting area 40.

Figure 2:
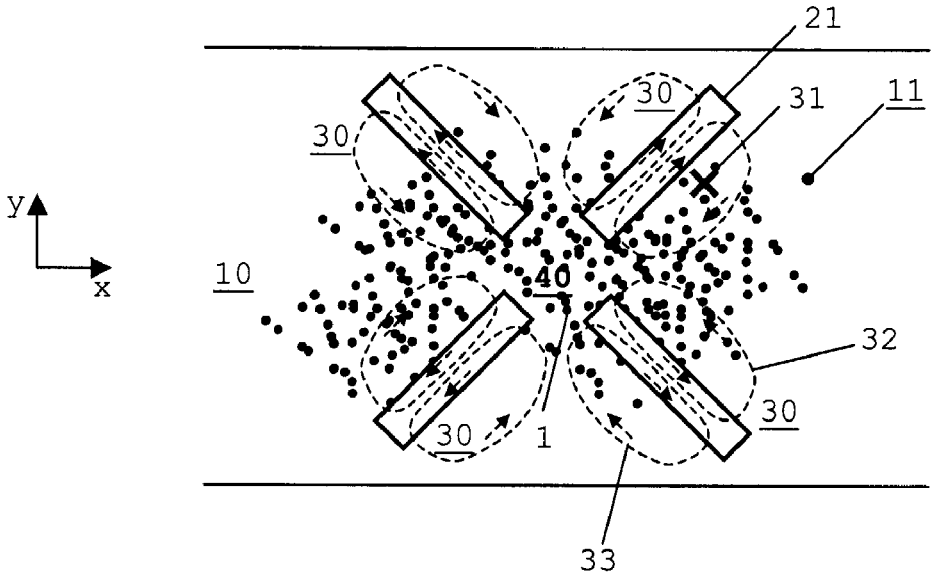
FIGS. 2, 3 show different phases in the collection of particles using the method according to the invention.
Figure 3:
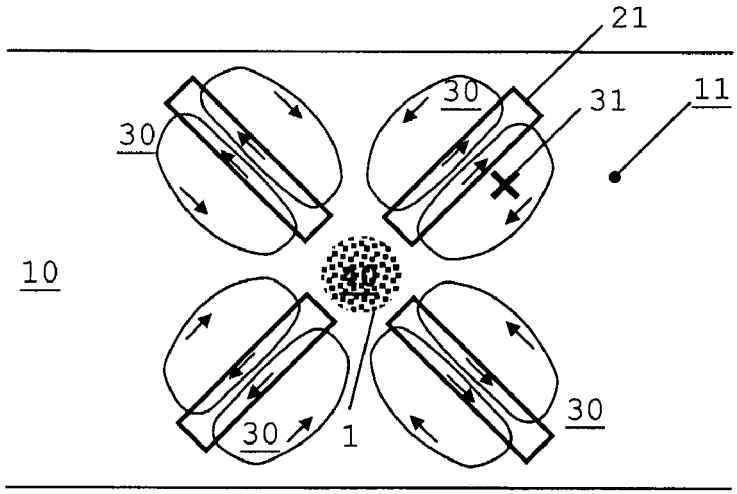

FIG. 2 illustrates the state of the collecting device immediately before the start of electrohydrodynamic collection. Particles 1 are randomly distributed in the compartment 10 for as long as the electrodes 21 are free of any voltage or are supplied with a relatively low voltage (<1 V). When the electrodes are supplied with high-frequency voltages of sufficiently high amplitude, the flows 30 are formed (also shown in FIG. 2 for illustration purposes). One or two locally circulating flows 32, 33 are generated at each electrode. A first flow branch of each flow runs along the longitudinal orientation of the electrode 21 and parallel to the lateral surface 11 through the compartment 10 essentially in the direction of the collecting area 40, as illustrated in FIGS. 2 and 3. Another branch of the circulating flow 30 moves back over the electrode 21 in the opposite direction. The circulation takes place about an axis 31 which is perpendicular to the plane in which the electrodes are arranged. By means of the flows 30, the particles 1 are guided from the outer space outside the electrode arrangement 20 and into the inner collecting area 40, where they form an aggregate (FIG. 3).

Figure 4A:
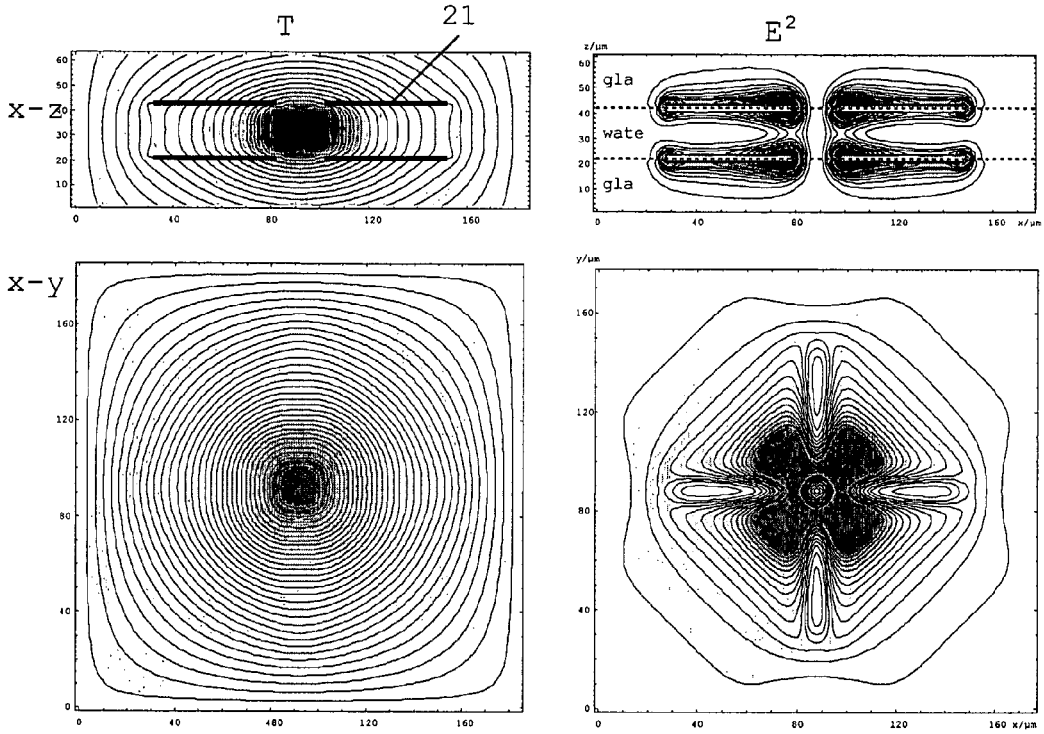
FIGS. 4A, 4B show illustrations of field and temperature conditions in a collecting device according to the invention and of experimental results which have been obtained with a collecting device according to the invention.

The cause of the electrohydrodynamic flow 30 is illustrated in FIG. 4A. The temperatures in the x-z plane (as shown in FIG. 1) and in the x-y plane (as shown in FIG. 2) are shown in the left-hand part of FIG. 4A. Without any external flow, a temperature profile is produced such that the collecting area 40 between the electrodes 21 is warmer than the surrounding solution. Since the electrical conductivity and the dielectric constant are temperature-dependent, the medium in the collecting area is dielectrically inhomogeneous. As a result, the electric field exerts polarization forces on the liquid, which forces lead to the formation of the desired flow eddies. Since the flow eddies are formed at all the electrodes, a symmetrical flow towards the centre of the cage and into the collecting area 40 takes place.

The temperature conditions of a liquid which is initially at rest in the compartment are shown in FIG. 4A (left-hand part). Surprisingly, the formation of the circulating flows in the direction of the collecting area also takes place if the liquid in the compartment is flowing. The liquid forms a carrier stream with a speed which is lower than the speed of the liquid in the circulating flows.

Under the effect of the high-frequency fields in the compartment 10, dielectrophoretic forces are also exerted on the particles. The electric field conditions are accordingly illustrated in the right-hand part of FIG. 4A. This shows the square of the electric field strength ($E^2$) respectively in the x-z plane (as shown in FIG. 1) and in the x-y plane (as shown in FIG. 2). Particles which are to be transported into the interior of the field cage have to overcome a relatively high dielectric barrier in the x or y direction. After passing through the barrier under the effect of flow forces, the particles experience a dielectrophoretic force acting in the centre of the field cage, so that in the centre of the cage the collection is amplified to form aggregates which are subject to a greater volume force depending on the dimensions.

The voltage amplitude required to generate the electrohydrodynamic flow is selected as a function of the dielectric properties of the suspension liquid and the geometric properties of the electrode arrangement. It is also possible to provide for empirical selection by means of experiments. The high-frequency electric fields are preferably selected in such a way that only negative dielectrophoresis acts on the particles. The collection shown in FIGS. 2 and 3 can be carried out in order to collect 1 μm particles for example with the following operating parameters. The particles are suspended in KCl (concentration: 12.5 mM). The electrodes 21 are supplied with a high-frequency electric voltage (frequency: 8 MHz, amplitude: 3.5 V). The gap between the electrodes lying opposite one another in one plane (tip to tip) is 40 μm.

Figure 4B:
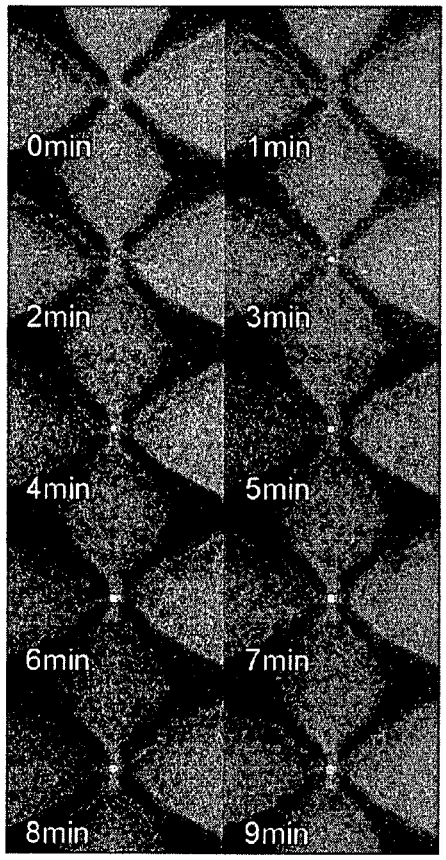

Under the following operating conditions, an accumulation of hepatitis-A viruses (diameter approx. 30 nm) could be achieved within 10 minutes. High-frequency AC voltages of frequency: 7.4 MHz, amplitude: 4 $V_{rms}$ electrode gap: 5 μm. The initial concentration of the viruses in the compartment was approx. $10^9$ to $10^{10}$/ml. The accumulation of fluorescence-marked hepatitis-A viruses for various observation times is shown in FIG. 4B. After 2 minutes, an initially small aggregate was formed from the viruses, which grew to a diameter of approx 4 μm (9 min.). For a catchment area of approx. 100 μm*100 μm*10 μm (channel height), this corresponds to concentrating by approx. $10^3$.

Figure 5:
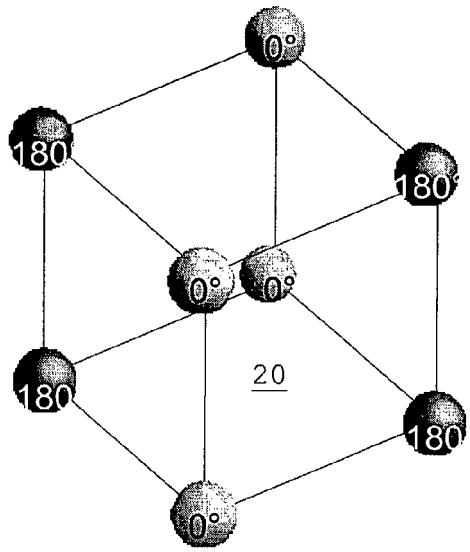
FIG. 5 shows an embodiment of a collecting device according to the invention with a row of collecting areas.
Figure 5:
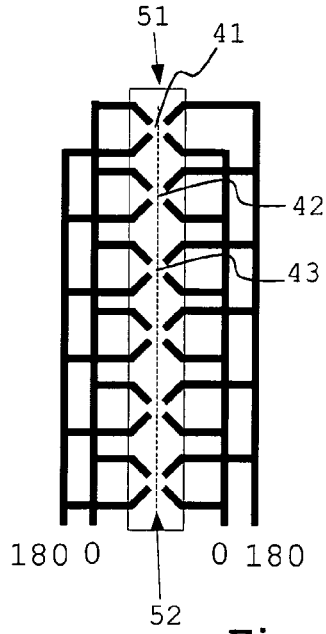

FIG. 5 schematically illustrates the formation of a row of collecting areas 41, 42, 43, . . . in the channel of a fluidic microsystem, wherein for reasons of clarity only the electrodes 21 of the electrode arrangements on one of the lateral surfaces of the channel are shown, along with the associated connecting lines via which the electrodes 21 are connected to a voltage source. The left-hand part symbolically illustrates the activation, in phase opposition, of respectively adjacent electrodes in an individual field cage 20, by means of which the desired flow eddy can be generated at each collecting area 41, 42, 43, . . . .

Located outside the fluidic microsystem is a measuring device (not shown) by means of which the particles in the collecting areas 41, 42, 43, . . . are measured through a window 51 along a sampling line 52. For example, a fluorescence correlation measurement (FCS) takes place in order to detect receptor/ligand binding events in the collected particles.

Figure 6:
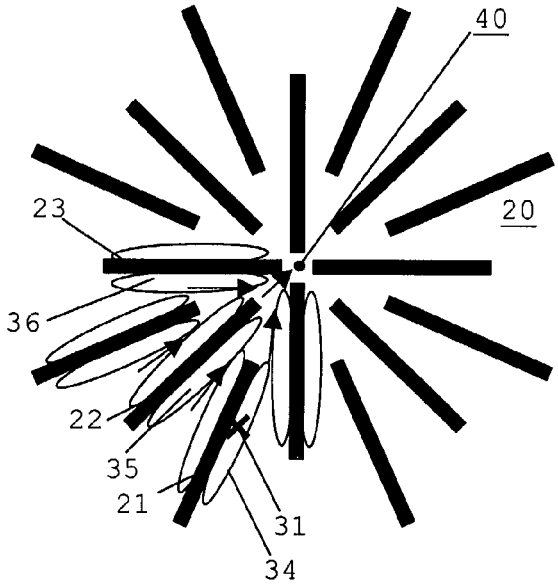
FIG. 6 shows a further embodiment of a collecting device according to the invention with a cascade of collecting areas.

A cascade-type combination of a plurality of circulating flows is illustrated schematically in FIG. 6. In this embodiment of the invention, a flow directed towards the collecting area 40 is generated by the electrode arrangement 20 over a relatively large area. By way of example, a plurality of collecting electrodes 21, 22 which point radially towards the collecting area 40 are provided. The innermost electrodes 23 simultaneously form collecting and cage electrodes, which form a field cage as shown in FIG. 2. Particles located in the outer region are conveyed for example by the eddy 34 at the first collecting electrode 21 into the eddy 35 of the second collecting electrode 22, from which they are further transported to the eddy 36 of the collecting and cage electrode 23. The latter conveys the particles into the central collecting area 40.

FIG. 6 illustrates that two eddies are formed at each strip-shaped electrode, wherein the axis 31 (shown offset) for flow circulation is oriented perpendicular to the adjacent lateral surface with the electrodes. In a manner differing from the illustrated straight strip shape, the electrodes in the embodiment of the invention shown in FIG. 6 or in the examples of embodiments described above can also have a conical shape, in which the width of the electrode strip spreads outwards as the radial distance from the collecting area increases. This configuration makes it possible to expand the catchment area of the collecting flows. It is also possible as an alternative that the electrodes have a straight strip shape and the electrodes at a radial distance from the collecting area become larger as this distance increases. By way of example, narrow, small electrodes are provided on the inside and wide, large electrodes are provided on the outside, wherein for example the aspect ratio of the electrodes increases towards the outside.

Figure 7:
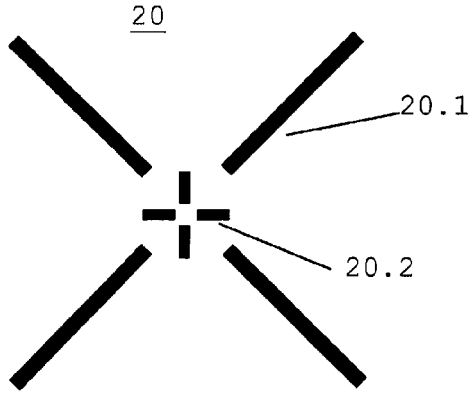
FIG. 7 shows a further embodiment of a collecting device according to the invention with a cascade of collecting areas.

FIG. 7 illustrates an embodiment of the collecting device according to the invention with an electrode arrangement 20 which comprises an outer cage 20.1, in the trapping area of which an inner cage 20.2 is formed. Each of the inner and outer field cages 20.1 and 20.2 is a closed field cage comprising 8 electrodes. The associated electrode arrangements are arranged offset by 45° relative to one another, as a result of which the cooperation of the two field cages is improved.

Figure 8:
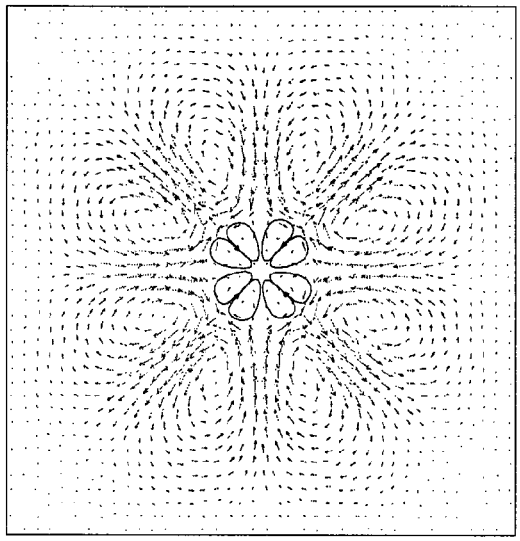
FIG. 8 shows an illustration of the flow conditions in a collecting device as shown in FIG. 7, and FIGS. 9, 10 show illustrations of conventional collecting techniques (prior art).
Figure 9:
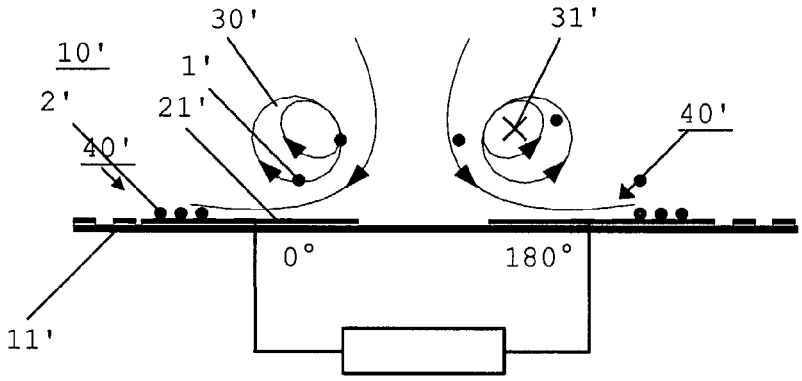
Figure 10:
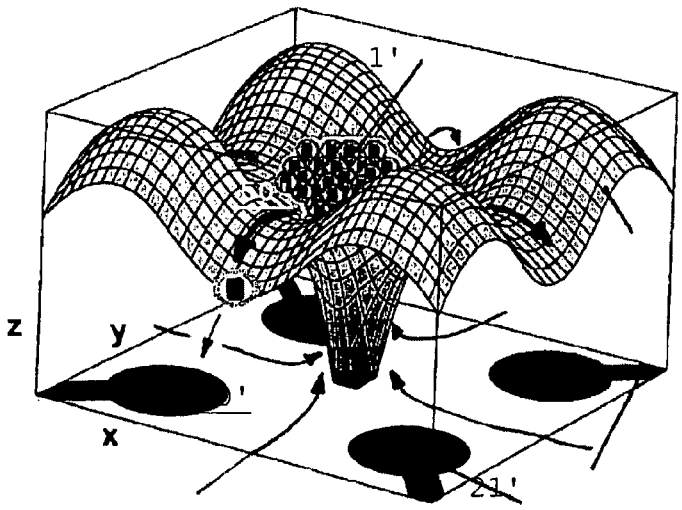

FIG. 8 illustrates the flow profiles (numerical simulation) which result in the embodiment shown in FIG. 7. The flow profiles are shaped in such a way that the catchment area of the electrode arrangement 20 is enlarged and also the central resting zone or particle collecting zone is expanded. Compared to the concentric double arrangement, the outer field cage 20.1 alone would provide a reduced flow and thus less effective particle transport, whereas the inner field cage 20.2 alone would have a smaller catchment area and a smaller resting zone.

In the electrode arrangements shown in FIGS. 5, 6 and 7, the individual electrodes and their connecting lines to the voltage sources are electrically isolated from one another. The isolation takes place by means of a structure comprising multiple planes consisting of electrode layers and isolation layers.

According to a further modification of the invention, the collecting device may be equipped with a cooling device, e.g. a Peltier element, in order to prevent undesirable overall heating of the collecting device.

The features of the invention that are disclosed in the above description, in the drawings and in the claims may be of importance both individually and in combination with one another in order to implement the invention in its various embodiments.

The invention claimed is:

1. A method for collecting particles suspended in a liquid, said method comprising the steps of:

providing the liquid containing the suspended particles in a compartment having lateral surfaces, wherein a plurality of electrodes is arranged on the lateral surfaces, and generating high-frequency electric fields by way of said plurality of electrodes so as to form a plurality of circulating flows, at least one circulating flow being formed at each electrode of said plurality of electrodes, the particles being guided by said plurality of circulating flows to at least one predetermined collecting area in the compartment, wherein said electrodes are arranged on different sides of the collecting area, and wherein each flow of said plurality of circulating flows is formed in such a way that at least one branch of the flow runs along a longitudinal extent of a respective electrode, and the flow circulates about an axis oriented perpendicular to a respective adjacent lateral surface on which the electrode is arranged.

2. The method according to claim 1, wherein the particles are arranged in the collecting area without a contact with the lateral surface of the compartment.

3. The method according to claim 1, wherein the particles are arranged in the collecting area in such a way that they make contact with one of the lateral surfaces of the compartment.

4. The method according to claim 1, wherein a plurality of circulating flows are generated at one electrode in each case, and the plurality of flows guides the particles to the at least one collecting area.

5. The method according to claim 1, wherein the flows are generated in an essentially symmetrical manner relative to the collecting area.

6. The method according to claim 1, wherein, due to the high-frequency electric fields, forces are exerted on the particles by way of negative dielectrophoresis, said forces being directed towards the collecting area.

7. The method according to claim 1, wherein the high-frequency electric fields are generated by strip-shaped electrodes of an electrode arrangement for generating at least one dielectrophoretic field cage, said electrodes being arranged on the lateral surfaces of the compartment.

8. The method according to claim 7, wherein the dielectrophoretic field cage is generated with a potential minimum located in the collecting area.

9. The method according to claim 8, wherein a dielectrophoretic field cage which is closed in at least two spatial directions is generated.

10. The method according to claim 6, wherein the high-frequency electric fields are generated by electrodes of an electrode arrangement with an outer dielectrophoretic field cage and an inner dielectrophoretic field cage, wherein the electrodes are arranged on the lateral surfaces of the compartment.

11. The method according claim 1, wherein the particles are guided into the collecting area from a catchment area of the compartment, a volume of the catchment area being $10^2$ to $10^9$ times greater than a volume of the collecting area.

12. The method according to claim 11, wherein the catchment area has a volume of up to 50 μl and the collecting area has a volume of from 40 μl up to 1 fl.

13. The method according to claim 1, wherein, in the collecting area, at least one further force acts on the particles.

14. The method according to claim 13, wherein the force is an optically active force, a dielectrophoretic force or a magnetic force.

15. The method according to claim 1, wherein, in the collecting area, a measurement is carried out on the collected particles.

16. The method according to claim 15, wherein the measurement comprises an electrical, electrochemical or optical measurement.

17. The method according to claim 16, wherein the measurement comprises a detection of a receptor/ligand binding event.

18. The method according to claim 1, wherein, in the compartment, there is a plurality of collecting areas wherein particles are collected.

19. The method according to claim 1, wherein, in the compartment, a laminar flow or an ultrasonic field is generated and is superposed with the circulating flow.

20. The method according to claim 1, wherein, in the compartment, a plurality of circulating flows are generated and are superposed on one another.

21. The method according to claim 1, wherein particles with a diameter of less than 1 μm are collected.

22. The method according to claim 21, wherein the particles comprise cells, viruses, bacteria, proteins, cell constituents or biological macromolecules.

23. A collecting device for collecting particles suspended in a liquid, said device comprising:

a compartment delimited by lateral surfaces for holding the liquid containing the suspended particles, and a plurality of electrodes which is arranged on the lateral surfaces and is adapted to generate high-frequency electric fields in the compartment so as to form a plurality of circulating flows for guiding the particles to at least one predetermined collecting area in the compartment, wherein:

said electrodes each have an elongate shape with an aspect ratio of electrode width to electrode length from 1:10 to 1:100, said electrodes being adapted to form said plurality of flows in such a way that a branch of each flow runs along a longitudinal extent of a respective electrode, and at least one axis, about which the flow circulates, is oriented perpendicular to an adjacent lateral surface on which said electrodes are arranged.

24. The device according to claim 23, wherein the collecting area is arranged at a distance from the lateral surfaces of the compartment.

25. The device according to claim 23, wherein the collecting area makes contact with one of the lateral surfaces of the compartment.

26. The device according to claim 23, wherein cage electrodes for generating at least one dielectrophoretic field cage are arranged on the lateral surfaces of the compartment.

27. The device according to claim 26, wherein the cage electrodes form part of the electrode arrangement.

28. The device according to claim 26, wherein the cage electrodes form an outer dielectrophoretic field cage and an inner dielectrophoretic field cage arranged inside the outer dielectrophoretic field cage.

29. The device according to claim 23, wherein at least one of a heating device, a cooling device and a light source is provided.

30. The device according to claim 23, wherein the collecting area is equipped with a magnetic field device.

31. The device according to claim 23, which is equipped with a measuring device for detecting electrical or optical properties of particles in the collecting area.

32. The device according to claim 23, wherein at least one of the lateral surfaces of the compartment, in the region of the at least one collecting area, is functionalized with detection spots in the form of receptor molecules.

33. The device according to claim 23, wherein a plurality of collecting areas is provided.

34. The device according to claim 23, wherein the compartment forms part of a channel of a fluidic microsystem.

35. The device according to claim 34, wherein the collecting areas are arranged in a row along a longitudinal direction of the channel.

* * * * *